US008978282B2

(12) United States Patent
Garrett

(10) Patent No.: US 8,978,282 B2
(45) Date of Patent: Mar. 17, 2015

(54) LEVER FOR AMBIDEXTROUS MAGAZINE RELEASES FOR FIREARMS

(76) Inventor: Robert Hudson Garrett, Manassas, VA (US)

( * ) Notice: Subject to any disclaimer, the term of this patent is extended or adjusted under 35 U.S.C. 154(b) by 0 days.

(21) Appl. No.: 13/591,175

(22) Filed: Aug. 21, 2012

(65) Prior Publication Data

US 2014/0053444 A1 Feb. 27, 2014

(51) Int. Cl.

| | |
|---|---|
| ***F41A 9/65*** | (2006.01) |
| ***F41A 17/38*** | (2006.01) |
| ***F41A 35/06*** | (2006.01) |

(52) U.S. Cl.

CPC ..... *F41A 17/38* (2013.01); *F41A 35/06* (2013.01)

USPC ..... 42/6

(58) Field of Classification Search

CPC ..... F41A 17/38; F41A 3/66; F41A 9/65; F41A 35/06; F41A 9/59; F41A 9/64

USPC ..... 42/6, 17, 18, 90, 7, 70.02, 49.01, 22; 89/1.4, 197, 33.1; 74/519

See application file for complete search history.

(56) References Cited

U.S. PATENT DOCUMENTS

| | | | | |
|---|---|---|---|---|
| 2,523,489 | A * | 9/1950 | Winter, Jr. | 184/6.9 |
| 4,615,134 | A | 10/1986 | Beretta | |
| 5,519,954 | A * | 5/1996 | Garrett | 42/6 |
| 6,901,837 | B2 | 6/2005 | Johnson | |
| 7,661,219 | B1 | 2/2010 | Knight, Jr. et al. | |
| 7,921,587 | B2 | 4/2011 | Mayberry | |
| 2006/0123683 | A1 | 6/2006 | Garrett et al. | |
| 2010/0281736 | A1 * | 11/2010 | Mayberry et al. | 42/49.01 |
| 2010/0287806 | A1 | 11/2010 | Marifone et al. | |
| 2011/0056107 | A1 | 3/2011 | Underwood | |

* cited by examiner

*Primary Examiner* — Samir Abdosh
*Assistant Examiner* — John D Cooper

(57) ABSTRACT

A lever protects against inadvertent release of a magazine of a firearm if its ambidextrous release is hit by equipment when the firearm is carried. The lever is made from a projection, above the pivot point, having two opposing angles forward of the depression surface. The projection impacts the equipment before the depression surface is impacted (straight-on impact), which protects the assembly from inadvertent release of the magazine. An impact to the rear angle of the projection (a rear impact) increases the engagement of the lever with the magazine. An impact along the forward angle (from the front or straight-on) of the projection also serves to increase engagement of the lever with the magazine. The lever, with its projection having opposing angles, is specifically designed to protect the lever of an ambidextrous magazine catch from inadvertent release by impact/snag in the field.

8 Claims, 3 Drawing Sheets

LEVER FOR AMBIDEXTROUS MAGAZINE RELEASES FOR FIREARMS

BACKGROUND OF THE INVENTION

The present invention relates to firearm components and, more particularly, to an improved lever for ambidextrous magazine releases for firearms to prevent inadvertent release of the magazine.

Existing magazine release mechanisms are prone to inadvertent release due to the absence of a fence on the receiver to protect the levers from impact by equipment.

Existing ambidextrous magazine releases have a lever which cams on a self-contained "pivot-point" or "cam" off the side of the receiver to pull the catch away from engagement with the magazine. Most firearms in which these ambidextrous releases operate are not equipped with a "fence" to protect the lever from inadvertent release on the catch side of the firearm.

As can be seen, there is a need for an improved lever for ambidextrous magazine releases for firearms that can prevent the inadvertent release of the magazine.

SUMMARY OF THE INVENTION

In one aspect of the present invention, a lever for releasing a magazine from a firearm comprises a tooth for engaging the magazine; a pin hole operable to receive a pin to permit the lever to pivot thereupon; a depression surface operable to pivot the tooth away from the magazine; a rear angled surface extending adjacent to the depression surface; and a front angled surface extending along an upper surface of the lever.

In another aspect of the present invention, a lever for releasing a magazine from a firearm comprises a tooth for engaging the magazine; a pin hole operable to receive a pin to permit the lever to pivot thereupon; a depression surface operable to pivot the tooth away from the magazine; a rear angled surface extending adjacent to the depression surface, the rear angled surface forming a first angle from about 92 to about 130 degrees relative to a plane of the depression surface; a front angled surface extending along an upper surface of the lever, the front angled surface forming a second angle from about 185 to about 225 degrees relative to the depression surface; and an elevated boss disposed between the rear angled surface and front angled surface.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a lever to protect against inadvertent release of a magazine of a firearm if its ambidextrous release is hit by equipment when the firearm is carried. The lever is made from a projection, above the pivot point, having two opposing angles forward of the depression surface. The projection impacts the equipment before the depression surface is impacted (straight-on impact), which protects the assembly from inadvertent release of the magazine. An impact to the rear angle of the projection (a rear impact) increases the engagement of the lever with the magazine. An impact along the forward angle (from the front or straight-on) of the projection also serves to increase engagement of the lever with the magazine. The lever, with its projection having opposing angles, is specifically designed to protect the lever of an ambidextrous magazine catch from inadvertent release by impact/snag in the field.

Figure 1:
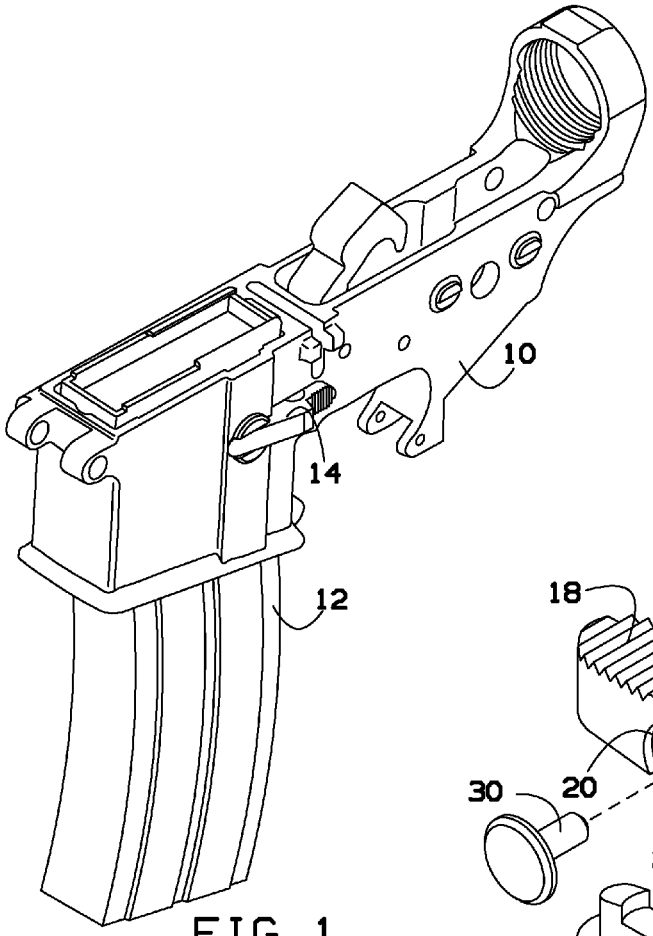
FIG. 1 is a perspective view of a lever for ambidextrous magazine release for a firearm, disposed in a firearm, according to an exemplary embodiment of the present invention.
Figure 2:
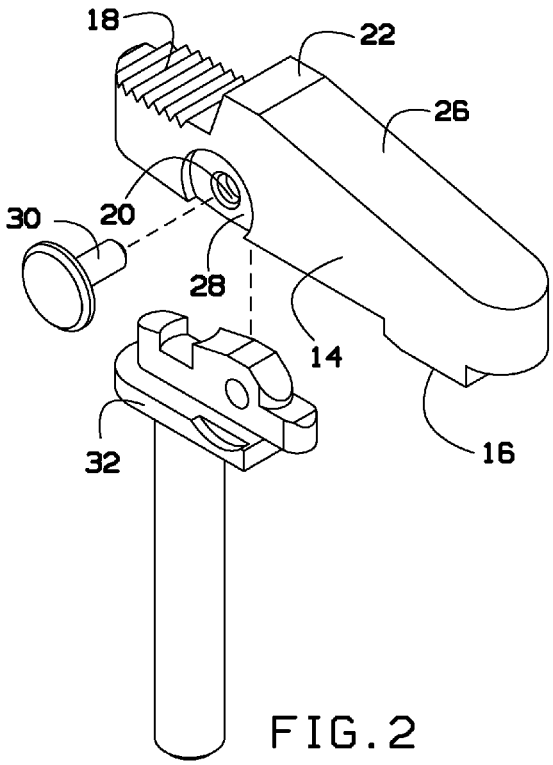
FIG. 2 is an exploded perspective view of the lever of FIG. 1.
Figure 3:
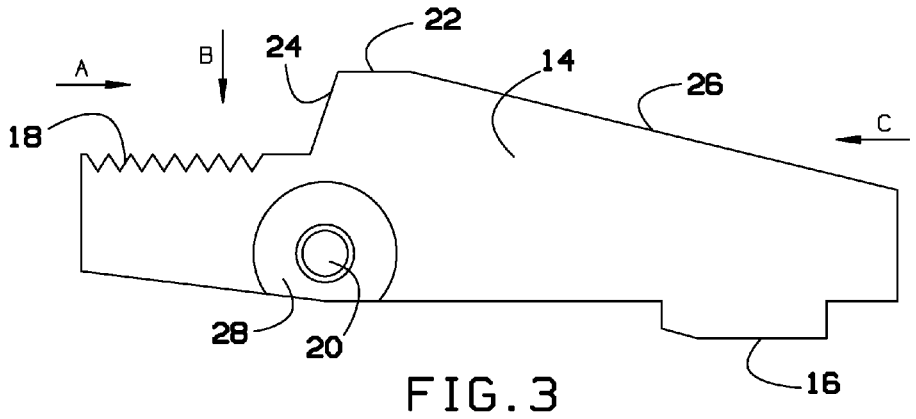
FIG. 3 is a side view of the lever of FIG. 1.
Figure 4:
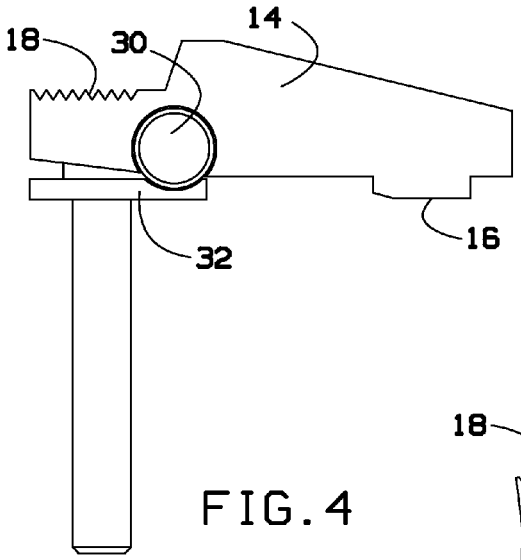
FIG. 4 is a side view of the lever of FIG. 1, showing the lever pivoted to a disengaged position.
Figure 5:
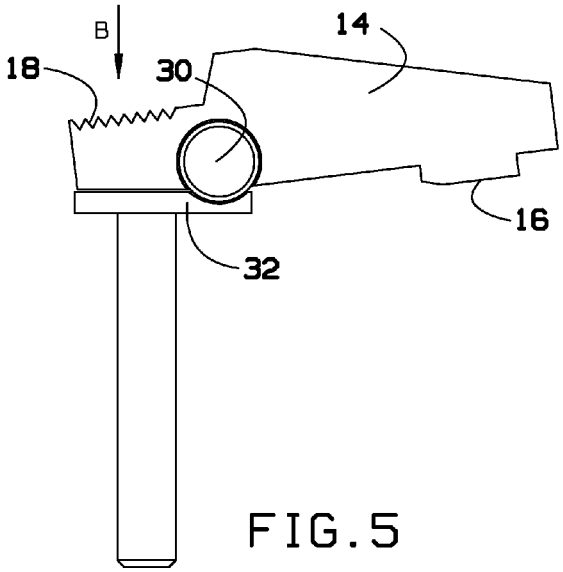
FIG. 5 is a side view of the lever of FIG. 1, showing the lever pivoted to a disengaged position.

Referring to FIG. 1, a receiver body of a firearm 10 can include a lever 14 that, when actuated, can remove a magazine 12 from a firearm 10.

Referring now to FIGS. 2 through 5, the lever 14 has a tooth 16 for engagement with the magazine 12 of a firearm, holding the magazine 12 within the firearm. The lever 14 can include a depression surface 18 which can be depressed by a user to actuate the release of the tooth 16 from the magazine 12, allowing for release of the magazine 12 from the firearm 10.

A pin hole 20 is provided to allow for insertion of a pin 30 to pivotally attach the lever 14 to a base 32. A pin head recess 28 may be optionally provided about the pin hole 20 to permit the head of the pin 30 to sit flush or nearly flush with the side of the lever 14.

An elevated boss 22 of the lever 14 includes a rear angled surface 24 and a front angled surface 26. The rear angled surface 24 and front angled surface 26 can act individually or together to protect the depression surface 18 from inadvertent actuation. The rear angled surface 24 can form an angle from about 92 to about 130 degrees, typically from about 95 degrees to about 120 degrees, relative to the plane of the depression surface 18. The front angled surface 26 can form an angle from about 185 degrees to about 225 degrees, typically from about 190 degrees to about 220 degrees, relative to the plane of the depression surface 18.

An impact to the rear angled surface 24 can rotate the lever 14 towards the firearm 10 which acts to positively engage the tooth 16 with the magazine 12, securing the magazine 12 in the firearm 10. An impact straight-on to the front angled surface 26 also rotates the lever 14 toward the firearm 10 which acts to positively engage the tooth 16 with the magazine 12, securing the magazine 12 in the firearm 10. An impact to the front angled surface 26 from the front of the lever 14 towards the depression surface 18 deflects the firearm 10 away from the equipment/obstacle simultaneously rotating the lever 14 toward the firearm 10 which acts to positively engage the tooth 16 with the magazine 12, securing the magazine 12 in the firearm 10.

Figure 6:
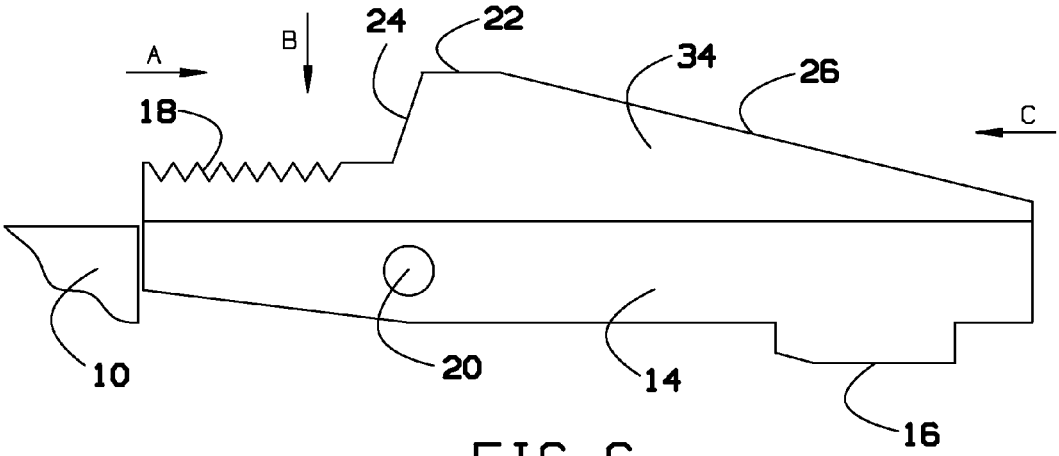
FIG. 6 is a side view of an alternate embodiment of the present invention, showing a slidable lever portion in a disengaged position relative to the receiver body.

Referring now to FIG. 6, a slidable lever portion 34 can be slidably attached to the lever 14. The slidable lever portion 34 can include a resilient means and a stop to station slidable lever portion 34 and lever 14 as shown in FIG. 6 such that when the depression surface 18 is moved in direction "B", slidable lever portion 34 does not impact the receiver body 10.

Figure 7:
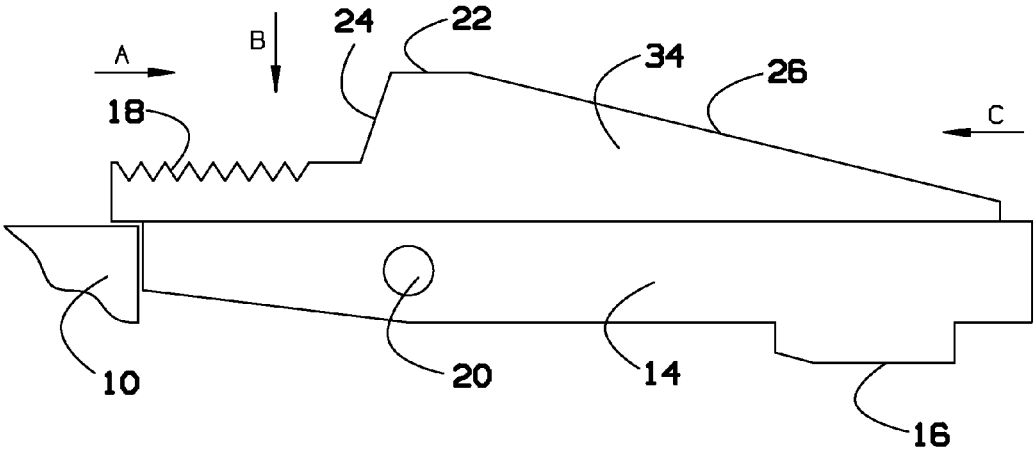
FIG. 7 is a side view of the slidable lever of FIG. 6, in an engaged position.

Referring to FIG. 7, the slidable lever portion 34, when impacted along the front angled surface 26 in direction "C", the slidable lever portion 34 moves over the receiver body 10, limiting movement of the lever 14 in direction "B", maintaining engagement of the tooth 16 with the magazine 12, holding the magazine 12 in the firearm. An included resilient means and stop can return the slidable lever portion 34 in direction "A" until the slidable lever portion 34 is stationed over lever 14 as shown in FIG. 6, allowing the depression surface 18 to be rotated in direction "B" without impacting the receiver body 10, moving tooth 16 out of engagement with the magazine 12, allowing for the intentional removal of the magazine 12 from the firearm.

The lever 14 of the present invention can be made from various methods and materials. Typically, the lever 14 can be machined from steel or other material using CAD/CAM or molded using the MIM process or investment casting/secondary machining.

The height of the elevated boss 22 can be increased or decreased to provide more protection or more clearance. Rear angled surface 24 and front angled surface 26 could be adjusted to provide better protection.

A detachable enlarged depression surface 18 could be added to provide more surface area for depression. This may be useful, for example, if the user is wearing gloves or mittens.

It should be understood, of course, that the foregoing relates to exemplary embodiments of the invention and that modifications may be made without departing from the spirit and scope of the invention as set forth in the following claims.

What is claimed is:

1. A firearm magazine release lever configured to release a magazine from a firearm, comprising:

a lever;

a tooth for engaging the magazine;

a pin hole operable to receive a pin to permit the lever to pivot thereupon;

a depression surface operable to pivot the tooth away from the magazine;

a rear angled surface extending adjacent to the depression surface;

and a front angled surface extending along an upper surface of the lever;

said angled surfaces being configured to ensure engagement of the tooth of the lever with said magazine when any of said angled surfaces are impacted.

2. The lever of claim 1, further comprising an elevated boss disposed between the rear angled surface and front angled surface said boss being higher than said depression surface.

3. The lever of claim 2, wherein the rear angled surface forms an angle extending from the rear of the elevated boss to the front of the depression surface.

4. The lever of claim 2, wherein the front angled surface forms an angle extending from the front of the elevated boss to front of the lever.

5. The lever of claim 1, further comprising a pin head recess disposed about the pin hole.

6. A firearm magazine release lever configured to release a magazine from a firearm, comprising:

a lever;

a tooth for engaging the magazine;

a pin hole operable to receive a pin to permit the lever to pivot thereupon;

a depression surface operable to pivot the tooth away from the magazine;

a rear angled surface extending adjacent to the depression surface, the rear angled surface forming a first angle from 90 to 45 degrees relative to the plane of the depression surface;

a front angled surface extending along an upper surface of the lever, the front angled surface forming a second angle from 175 to 150 degrees relative to the plane of the depression surface;

and an elevated boss disposed between the rear angled surface and front angled surface said boss being higher than said depression surface;

said angled surfaces being configured to ensure engagement of the tooth of the lever with said magazine when any of said angled surfaces are impacted.

7. The lever of claim 6, wherein the rear angled surface forms a first angle extending from the rear of the elevated boss to the front of the depression surface.

8. The lever of claim 6, wherein the front angled surface forms a second angle extending from the front of the elevated boss to front of the lever.

* * * * *